US006112815A

United States Patent [19]

Bøe et al.

[11] Patent Number: 6,112,815

[45] Date of Patent: Sep. 5, 2000

[54] INFLOW REGULATION DEVICE FOR A PRODUCTION PIPE FOR PRODUCTION OF OIL OR GAS FROM AN OIL AND/OR GAS RESERVOIR

[75] Inventors: Einar Bøe, Notodden; Olav Sveinung Haugerud, Bø i Telemark; Hans-Paul Carlsen, Notodden, all of Norway

[73] Assignee: Altinex AS, Kokstad, Norway

[21] Appl. No.: 09/068,035

[22] PCT Filed: Oct. 28, 1996

[86] PCT No.: PCT/NO96/00256

§ 371 Date: Aug. 5, 1998

§ 102(e) Date: Aug. 5, 1998

[87] PCT Pub. No.: WO97/16623

PCT Pub. Date: May 9, 1997

[30] Foreign Application Priority Data

Oct. 30, 1995 [NO] Norway ..... 954352

[51] Int. Cl.[7] ..... E21B 34/12

[52] U.S. Cl. ..... 166/320; 166/242.1; 166/316; 166/319; 166/370

[58] Field of Search ..... 166/205, 242.1, 166/242.7, 243, 316, 319, 320, 332.1, 369, 370, 373

[56] References Cited

U.S. PATENT DOCUMENTS

| | | | |
|---|---|---|---|
| 1,803,839 | 5/1931 | Cavins | 166/242.1 |
| 4,577,691 | 3/1986 | Huang et al. | 166/263 |
| 4,691,778 | 9/1987 | Pyne | 166/332.1 |
| 4,779,682 | 10/1988 | Pelzer | 166/370 |
| 4,821,801 | 4/1989 | Van Lear | 166/370 X |
| 4,858,691 | 8/1989 | Ilfrey et al. | 166/278 |
| 4,945,995 | 8/1990 | Tholance et al. | 166/381 X |
| 5,211,241 | 5/1993 | Mashaw, Jr. et al. | 166/320 |
| 5,337,808 | 8/1994 | Graham | 166/191 |
| 5,435,393 | 7/1995 | Brekke et al. | 166/370 |
| 5,447,201 | 9/1995 | Mohn | 166/375 |
| 5,474,128 | 12/1995 | Bitting | 166/242.7 |
| 5,673,751 | 10/1997 | Head et al. | 166/242.1 X |
| 5,803,179 | 9/1998 | Echols et al. | 166/370 |

FOREIGN PATENT DOCUMENTS

| | | |
|---|---|---|
| 0 507 498 AA | 7/1992 | European Pat. Off. . |
| 0 588 421 A1 | 3/1994 | European Pat. Off. . |
| 2 169 018 | 7/1986 | United Kingdom . |
| 2 262 954 | 7/1993 | United Kingdom . |
| WO 92/08875 | 5/1992 | WIPO . |

*Primary Examiner*—George Suchfield
*Attorney, Agent, or Firm*—Wenderoth, Lind & Ponack, L.L.P.

[57] ABSTRACT

Inflow regulation device for a production pipe for production of oil or gas from an oil- and/or gas reservoir (9), where the production pipe comprises a lower drainage pipe with drainage pipe sections (5) with one or more drainage pipe elements (2; 2*a*, 2*b*) having opening(s) (3; 3*a*, 3*b*) for inflow of oil and/or gas to an inner space (8) of the drainage pipe section. The inflow may be regulated by a movable sleeve (1) that abuts one adjacent side surface of the drainage pipe section (2; 2*a*, 2*b*) and where the sleeve is provided with a portion(s) (6) being able to cover/uncover the opening(s) in the drainage pipe element. The sleeve further comprises helical spurs/recesses (14, 15) that in conjunction with one adjacent abutting surface (18, 21) of the drainage pipe element (2; 2*a*, 2*b*) forms channels (16, 17) that may connect the reservoir (9) with the inner space (8) of the drainage pipe. The helical spurs/recesses (14, 15) may be constituted by one or more pair(s) of left- and/or right-oriented spurs/recesses. The sleeve (1) is axially movable by a double-acting ring piston device (21, 22) or by thread means (12, 13) arranged between the sleeve (1) and the drainage pipe element (2; 2*a*, 2*b*).

17 Claims, 6 Drawing Sheets

INFLOW REGULATION DEVICE FOR A PRODUCTION PIPE FOR PRODUCTION OF OIL OR GAS FROM AN OIL AND/OR GAS RESERVOIR

BACKGROUND OF THE INVENTION

The present invention relates to inflow regulation in a production pipe with a lower drainage pipe for production of oil or gas from a well in an oil- and/or gas reservoir. The invention comprises adjustable throttling or valve devices in conjunction with openings in the drainage pipe, providing that the inflow to the drainage pipe may be controlled according to the pressure profile of the reservoir. Thus, the invention is in particular very suitable for long horizontal wells in thin oil zones with high permeability in the geological formation.

From U.S. Pat. Nos. 4,821,801, 4,858,691, 4,577,691 and GB patent publication No. 2,169,018, there are known devices for recovery of oil and gas from long horizontal and vertical wells.

These known devices comprise a perforated drainage pipe with, for example, a filter for control of a sand around the pipe. A considerable disadvantage of the known devices for oil and/or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by this means will therefore be low. With thin oil zones and highly permeable geological formations, there is a high risk of coning, i.e. a flow of unwanted water or gas into the drainage pipe downstream, where the velocity of the oil flow from the reservoir to the pipe is highest.

The applicant's own EP-patent publication No. 0,588,421 discloses a production pipe for production of oil or gas from an oil or gas reservoir where a lower part of the pipe comprises a drainage pipe divided into a number of sections with one or more inflow-restriction devices that control the inflow of oil or gas from the reservoir to the drainage pipe on the basis of anticipated loss of pressure along the drainage pipe, the reservoir's anticipated productivity profile, and the anticipated inflow of gas or water.

The patent publication mentioned above discloses one embodiment of an inflow-restriction device, where a thickening in the form of a sleeve or gate is provided with one or more inflow channels, and where the inflow may be regulated by means of one or more screw or plug devices. By using short or long screws which extend into the channels. the flow-resistance in the channels can be varied. A further embodiment suggests to providing the drainage pipe with passing slots or holes and arranging a surrounding sleeve, which is movable in the lengthwise direction, at each section of the drainage pipe.

The above mentioned technology sustains satisfactory possibilities for the regulation of the inflow in the individual sections of the drainage pipe. Meanwhile, as the pipe has been installed in the reservoir, it has been experienced that a precise adjustment of the inflow at each section by the use of remote controlled means, such as coiled tubing or such as a well tractor tool, has been quite comprehensive and time consuming. Further, the inflow-restriction means described represent quite complex designs, that will require comprehensive and expensive machining operations in the manufacture of such inflow-restriction means.

SUMMARY OF THE INVENTION

According to the present invention, there is provided a device that make possible a simple and reliable regulation of the inflow, and that is well suited for adjustment by remote controlled means. The inflow regulation device according to the invention is of quite simple construction that can be manufactured with few time consuming and expensive machining operations, and can consequently be produced at low manufacturing costs. Further, the construction of the inflow device provides a primary possibility of regulation with respect to loss of dynamic pressure in the inflowing fluid, together with a secondary possibility of regulation that implies that the inflow may be completely shut off. Thus, the invention is well suited when exploiting reservoirs where the presence of water, oil/gas and the pressure conditions in the well along the drainage pipe may vary, and in particular when exploiting wells where the aforesaid conditions vary in dependence on the extraction rate.

BRIEF DESCRIPTION OF THE DRAWINGS

In the following, the invention will be further described with reference to embodiments and figures where.

DETAILED DESCRIPTION OF THE INVENTION

Figure 1A:
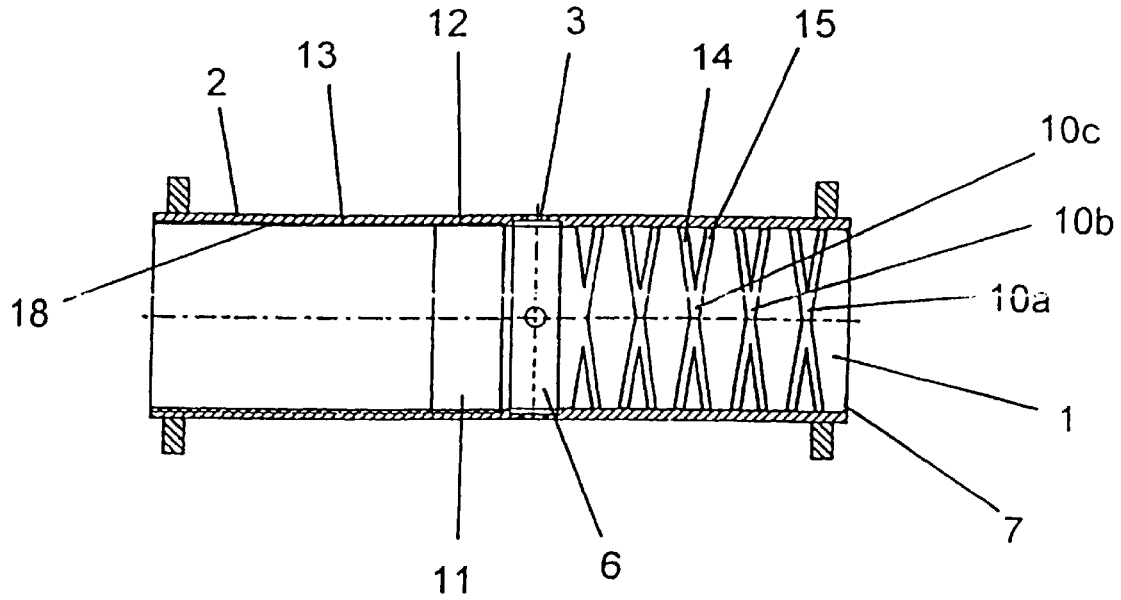
FIGS. 1*a* and 1*b* shows an inflow regulation device according to the invention.
Figure 1B:
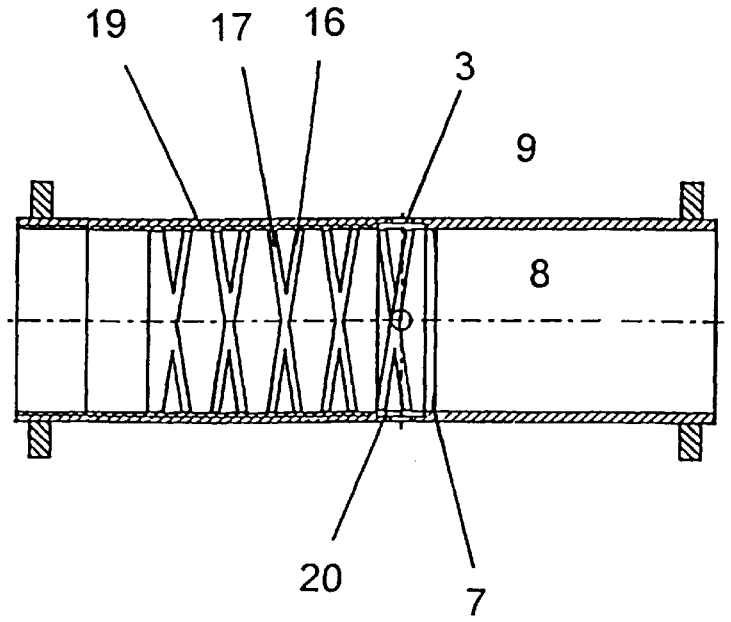

FIG. 1 shows an inflow regulation device where there is arranged an axially movable sleeve 1 at the inner side of a drainage pipe element 2. The sleeve is provided with helical spurs/recesses 14, 15 in the side surface abutting a co-operating side surface 18 of the drainage pipe element, in such a manner that the spurs/recesses in the sleeve are bounded radially by the drainage pipe element 2, thereby forming helical channels 16, 17 (FIG. 1*b*). At the right end of the sleeve, the channels 16, 17 communicate with the inner space 8 of the drainage pipe section. If the sleeve is moved to the left (FIG. 1*b*), opening(s) 3 in the drainage pipe element will be uncovered, thus establishing a communication between a reservoir 9 and the inner space 8 of the drainage pipe section by means of the channels 16, 17.

The opening 3 may be closed by an even portion 6 of the sleeve, as the sleeve is moved at its outermost position at the right (FIG. 1*a*). One portion 11 of the sleeve may be provided with thread means 12 that engage similar thread means 13 arranged in the drainage pipe element for the movement of the sleeve. Thus, by rotating the sleeve 1 it will move axially. The sleeve may for instance be rotated by the use of suitable well-tools, such as a well-tractor, but the arrangement of an actuator/motor, preferably a step-motor, represents an alternative technical solution.

Figure 2:
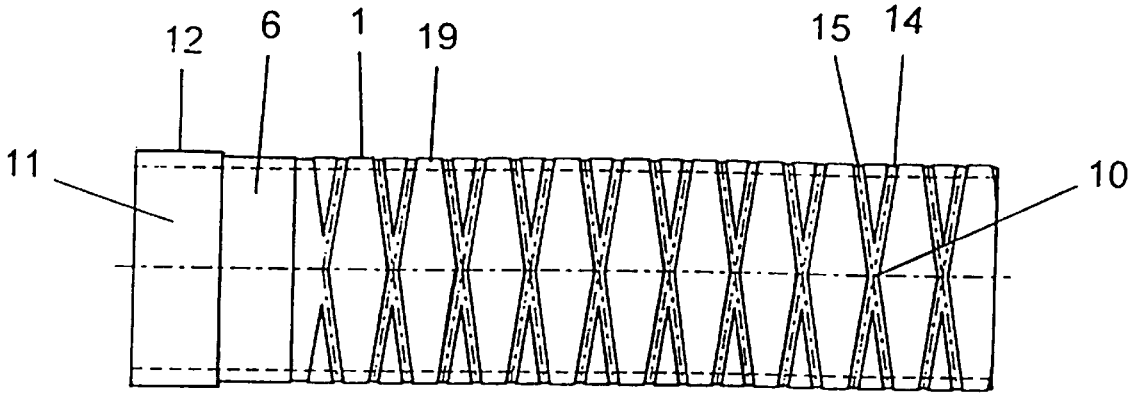
FIG. 2 shows a sleeve in accordance with the invention.

FIG. 2 shows a sleeve 1 according to the invention, where a pair of left- and right-oriented helical spurs/recesses 14, 15 are arranged in the outer surface of the sleeve, and where the spurs intersect at intersections 10 that support the forming of turbulence in the inflow. The spurs may advantageously have a quadrangular profile, but other types of profiles may also be convenient. Alternatively, there may be arranged more pairs of helical spurs/recesses in the surface of the sleeve to obtain more inlets and outlets. See FIG. 3 and FIG. 5.

The pitch of the helical spurs/recesses 14, 15 will determine at which angle the spurs/recesses intersect. The angle of intersection will be of great importance with respect to the flow resistance through the channels 16, 17. With a flat angle of intersection between the channels 16, 17, the resultant direction of the flow with respect to the sleeve will be mainly circumferential with a small axial component. As the flow in the left- and the right oriented channels 16, 17 have inverted flow components in the circumferential direction, substantial pressure losses may be achieved at each intersection 10, where these channels meet.

As mentioned above, the sleeve has a section 11 at its left end that is provided with thread means 12 co-operating with similar thread means in the abutting side surface 18 (FIG. 1*a*) of the drainage pipe element 2. Alternatively, the thread means 12, 13 may be arranged in the right end of the sleeve, whereby similar thread means are arranged in the drainage pipe element. This embodiment will be further described in the description of FIG. 4.

By this arrangement, for at least a part of the stroke of the sleeve, the thread means may be adapted to intersect the helical channels 16, 17 at intersections that cause formation of turbulence in the flow.

Figure 3:
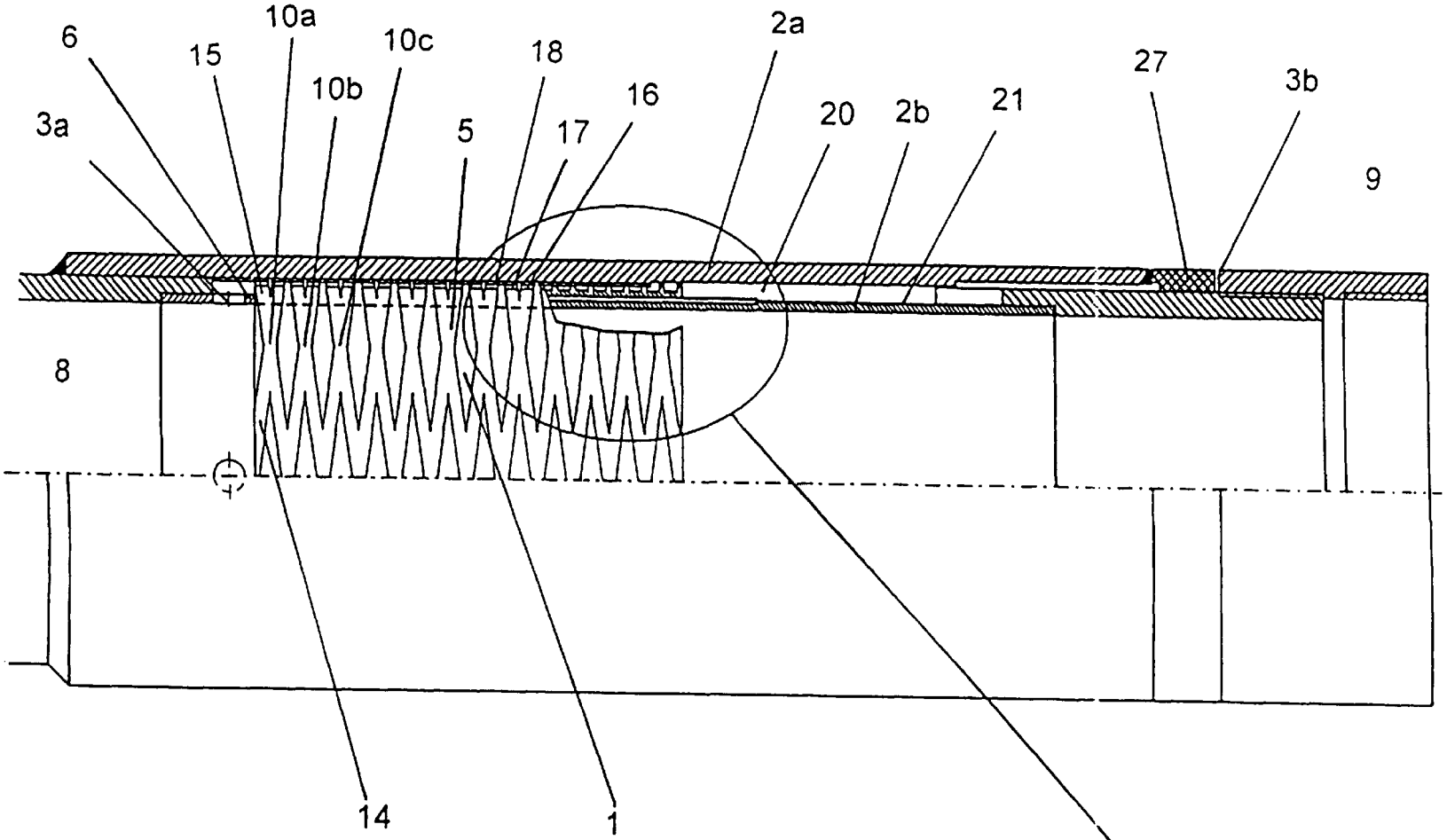
FIG. 3 shows an inflow regulation device according to the invention where the sleeve is arranged in an annulus

FIG. 3 shows an alternative embodiment of an inflow regulation device according to the invention, where a sleeve 1 is arranged in an annulus 20 defined between a first drainage pipe element 2*a* and a second drainage pipe element 2*b* coaxially arranged with respect to the first element. The sleeve 1 is provided with helical spurs/recesses 14, 15 that are dosed in a radial direction by an adjacent side surface 18 in the annulus, thereby forming channels 16, 17. One end of the annulus communicates with an oil/gas reservoir 9 by an opening 3*b* in the drainage pipe element 2*a*. The entrance of particles such as sand or the like is avoided by a filter 27 arranged at the opening 3*b*.

When the sleeve is in the position as shown in FIG. 3, fluid that flows from the reservoir 9 into the annulus 20, may enter channels 16, 17. At the left side of the sleeve, the fluid leaves the channels 16, 17 and enters an other end of the annulus 20. This section of the annulus communicates with the inner space 8 of the drainage pipe section via opening(s) 3*a* arranged in the second drainage pipe element 2*b*. As the sleeve is moved completely to the left, the opening(s) 3*a* would be totally covered by an even portion 6 of the sleeve 1, thereby cutting off the communication between the reservoir 9 and the inner space 8 of the drainage pipe section.

As mentioned above, FIG. 4 shows an enlarged cut-out of the device shown in FIG. 3. The sleeve 1 and the drainage pipe element 2*a* may be arranged for mutual rotation, to provide an axial movement of the sleeve. Co-operating thread means 12, 13 or similar devices are arranged in the outer surface of the sleeve and in the inner surface 18 of the drainage pipe section 2*a*. In a similar manner, anti-rotation contact means 23, 24 are arranged in the inner surface 22 of the sleeve 1 and the outer surface 21 of the second drainage pipe element 2*b*. The thread means 12, 13 may be constituted by cams/beads 12 arranged in one of the mutual surfaces and spurs/recesses 13 in the other. The anti-rotation contact means may in a similar manner be constituted by longitudinal spurs/recesses 23 and cams/beads 24 arranged in the respective surfaces.

Figure 4:
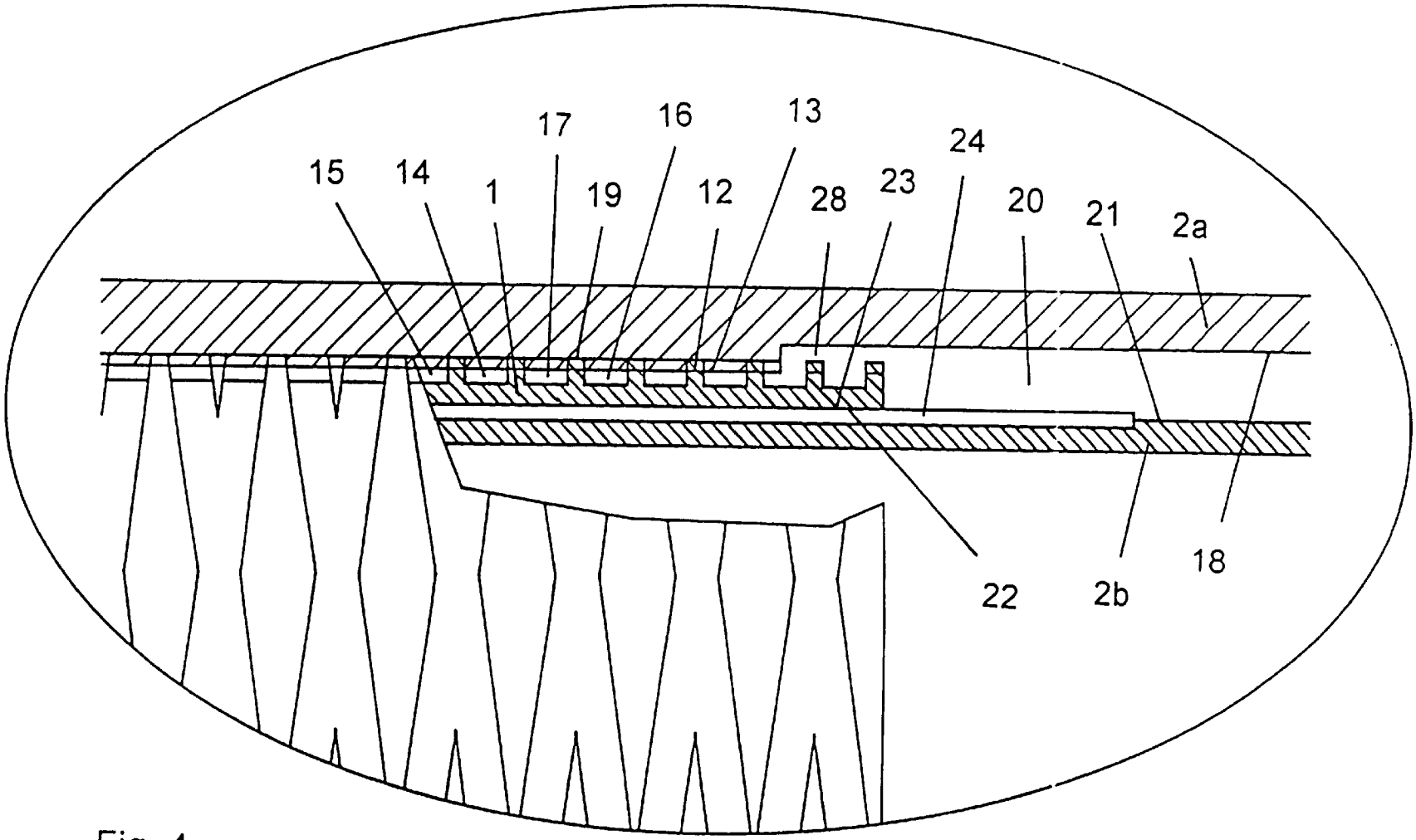
FIG. 4 shows an enlarged cut-out of the device as shown in FIG. 3.

In the embodiment as shown in FIG. 4, the thread means 12, 13 are arranged on the same surfaces as those that form the helical channels 16, 17, but alternatively the longitudinal anti-rotation contact means 23, 24 may be arranged on these surfaces, as the thread means 12, 13 could be arranged on the other surface of the sleeve 1 and its corresponding surface in the annulus.

The thread means 12, 13 arranged on the surface 19 of the sleeve and the surface 18 of the annulus, alternatively the longitudinal anti-rotation contact means 23, 24, may be formed in such a manner that they intersect the channels 16, 17 and thereby provide that the channels will have a sharp alteration in the cross-sectional area at the points of intersection. This sharp alteration in the cross-sectional area of the channels 16, 17 will cause the formation of turbulence in the flow, and consequently a loss in the pressure. As shown in the Figure, the number of intersections between thread means 13 in the annulus surface 18 and channels 16, 17 may be adjusted by moving the sleeve into a section of the annulus 20 where the surface of said annulus 18 is not provided with thread means 13.

The possibility of adjusting the number of intersections between channels 16, 17 and thread means 13, possibly anti-rotation contact means 24, is of great importance concerning the operating mode of the inflow regulation device. By moving the sleeve 1 in the device as shown in FIGS. 3 and 4 completely to the right, the opening 3*a* becomes totally uncovered and it will simultaneously have a minimum of intersections between channels 16, 17 and thread means 13, possibly anti-rotation contact means 24. Thus, there will be a minimum restriction of the inflow of the fluid from reservoir 9. As the sleeve is gradually moved to the left, the number of intersections will increase, and consequently there will be an increase in the restriction of the flow in the channels. Then a gradual increase in the restriction of the inflow from the reservoir to the inner space 8 of the drainage section can be achieved. As the sleeve has reached its outermost position to the left, the opening 3*a* will be totally covered by a section 6 of the sleeve, and the inflow will stop.

Figure 5:
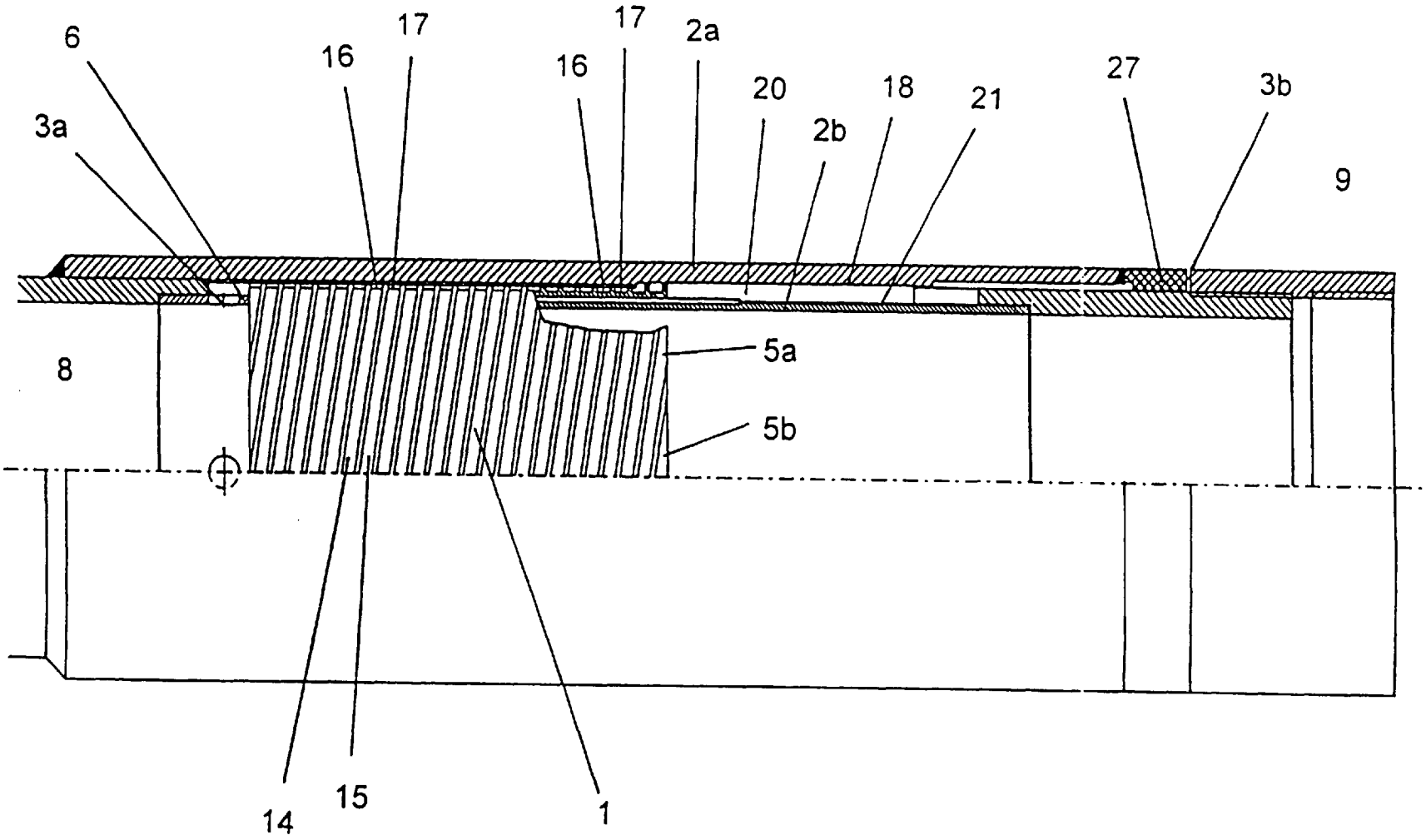
FIG. 5 shows, in an embodiment, an inflow regulation device as shown in FIG. 3, where the sleeve is provided with left-oriented helical spurs/recesses.

FIG. 5 shows a device similar to that shown in FIG. 3, but here the sleeve 1 is provided with more parallel helical spurs/recesses 14, 15 with inlets 5*a*, 5*b* that, together with the annulus 18, form channels 16, 17. In this embodiment, the connection between the inlet side of the annulus 20 and its outlet consists of several parallel channels 16, 17 with a corresponding number of inlets and outlets. As in the last example, the thread/contact means may be arranged in such a manner that they intersect the channels 16, 17 in a part of the annulus 20. Further, the sleeve may be moved to a section of the annulus 20 having an even annulus surface 18, where it consequently will be a smaller restriction of the flow. This embodiment, having channels 16, 17 that do not intersect each other, may advantageously have used when it is desirable to have less restriction of the inflow when the inflow regulation device is in its fully open position, than the restriction sustained by the device in the foregoing example. The restriction in the fully open position may be further decreased by giving the annulus surface 18 a shape such that it forms a space or clearance 28 (FIG. 4) between the sleeve and the annulus surface 18 at the section.

Figure 6:
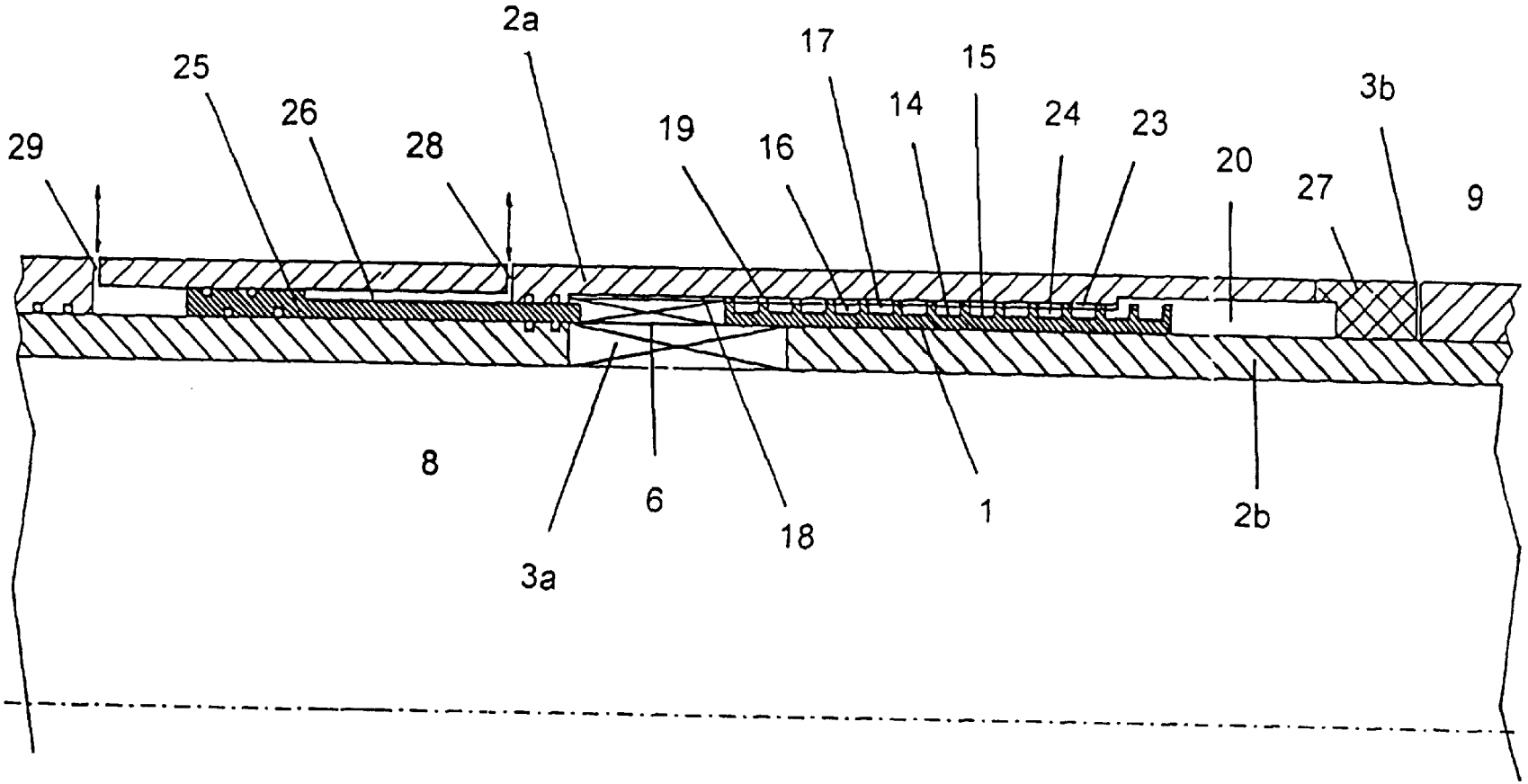
FIG. 6 shows an inflow regulation device according to the invention where the sleeve is arranged for movement by means of a ring piston device.

FIG. 6 shows an embodiment in which an inflow regulation device may be operated by a hydraulic, double-acting ring piston device 25, 26 having connectors for fluid 28, 29.

As shown in the Figure, a sleeve 1 may be connected to a ring piston 25 for axial movement. The ring piston may be arranged in a cylinder 26, or in an extension of an annulus 20 formed between a first drainage pipe element 2*a* and a second drainage pipe element 2*b* coaxially arranged with respect to the first drainage pipe element. As shown in the foregoing example, a reservoir 9 is in communication with the annulus 20 via an opening 3*b* in the drainage pipe element 2*a*. Fluid may flow from the annulus 20 via helical channels 16, 17 to a second section of the annulus 20 that it communicates with the inner space 8 of the drainage pipe section via one opening 3*a* in the second drainage pipe element 2*b*. Rotation of the sleeve and the piston may be omitted by the arrangement of anti-rotation contact means 23, 24 formed as longitudinal spurs/recesses and cams/beads in a surface 19 of the sleeve and in the adjacent surface of the annulus.

Preferably, anti-rotation contact means 23 are arranged in the same surface of the sleeve as the helical channels 16, 17, whereby intersections are formed between contact means 24 in the adjacent surface 18 of the annulus and the channels 16, 17, similar to the foregoing example. The surface 18 of the annulus may further have a section that is not provided with anti-rotation contact means 24 that allows the number of intersections to be adjusted as the sleeve is moved into this section. Correspondingly, the restriction of the flow will then be adjusted. Analogous with the foregoing example, the sleeve may be moved to an outermost position at the left where the opening 3*a* will be covered by an even portion 6 of the sleeve, and the communication between the reservoir 9 and the inner space 8 of the drainage pipe section will be cut-off.

Alternatively, the second drainage pipe element may be omitted, whereby the inflow regulation device then comprises two main components, the sleeve and the drainage pipe, similar to the embodiment shown in FIG. 1. In this case, the double-acting ring piston device may be built-in as a separate unit (not shown).

It shall be understood that sealing means (not shown) may be arranged between the drainage pipe and the well wall (reservoir), whereby one or more inflow regulation device(s) communicate with one or more selected sector(s) of the reservoir. This technology will not be further described here, but is disclosed in the above mentioned EP 0,588,421.

The invention is not limited by the foregoing examples. Within the frame of the following claims the movable sleeve 1 may be arranged at the outside of the drainage pipe 2, 2*a* and may possibly be surrounded by a second drainage pipe element. Further, it should be understood that the helical spurs/recesses in the sleeve possibly may be in abutment with the adjacent surface of the second drainage pipe element 2*b*, whereby the channels 16, 17 are formed between the sleeve 1 and the second pipe 2*b*. Furthermore, the spurs/recesses 14, 15 may be arranged in the inner surface of the sleeve 1, and still further the adjacent drainage pipe element (2, 2*a*, 2*b*) may be so formed that intersections between channels 16, 17 and thread means 13/contact means 24 are provided analogous to the foregoing examples. It shall still further be understood that the movement of the sleeve may be performed by the use of other means than those mentioned. Thus pneumatic, electric or electromagnetic actuators/motors may be used for this purpose.

What is claimed is:

1. Inflow regulation device for a production pipe for production of oil or gas from an oil- and/or gas reservoir, where the production pipe comprises a lower drainage pipe with one or more drainage pipe sections with at least one drainage pipe element having an opening for inflow of oil and/or gas from the reservoir to the inner space of the drainage pipe section, where the inflow may be regulated by at least one inflow regulation device comprising one movable sleeve that abuts one adjacent side surface of the drainage pipe section and where the sleeve is provided with a section able to cover/uncover the opening in the drainage pipe section and further with a flow channel adapted to connect the reservoir with the inner space of the drainage pipe section, wherein the flow channel is constituted by one or more helical spurs/recesses arranged in the side surface of the sleeve, whereby the spurs/recesses are arranged in that side surface of the sleeve abutting the side surface of the drainage pipe element.

2. Device according to claim 1, wherein the helical spurs/recesses in the sleeve are arranged as one or more pairs of left- and/or right-oriented spurs/recesses.

3. Device according to claim 2, wherein the sleeve is connected to an actuator or linear motor for axial movement of the sleeve.

4. Device according to claim 2, wherein the sleeve and the drainage pipe element are arranged for relative rotation and the adjacent side surfaces of the sleeve and the drainage pipe are provided with threads, whereby the sleeve is moved axially by relative rotation of the drainage pipe and the sleeve.

5. Device according to claim 1 wherein the sleeve is connected to an actuator or linear motor for axial movement of the sleeve.

6. Device according to claim 5, wherein the actuator or linear motor is a double-acting ring piston device.

7. Device according to claim 6, wherein the adjacent side surfaces of the sleeve and the drainage pipe element have longitudinal mutually co-operating contact elements that impede rotation of the sleeve with respect to the drainage pipe element.

8. Device according to claim 7, wherein the longitudinal contact elements are arranged to intersect the helical channels, causing the formation of turbulence in flow through the channels at points of intersection with the contact elements, whereby an increased inflow restriction is obtained.

9. Device according to claim 8, wherein the side surface of the drainage pipe element adjacent to the helical spurs/recesses in the sleeve comprises a section without the longitudinal contact elements, whereby the number of intersections between the contact elements and the helical channels decreases as the sleeve enters the section, thus resulting in a reduction in inflow restriction.

10. Device according to claim 9, wherein the side surface of the drainage pipe element is provided with a section having a shape such that a space or clearance between the sleeve and the side surface is formed, whereby the inflow restriction is further reduced as the sleeve enters the section.

11. Device according to claim 1, wherein the sleeve and the drainage pipe element are arranged for relative rotation and the adjacent side surfaces of the sleeve and the drainage pipe are provided with threads, whereby the sleeve is moved axially by relative rotation of the drainage pipe and the sleeve.

12. Device according to claim 11, wherein the sleeve is arranged between two drainage pipe elements adapted for relative rotation, threads are arranged in one of the side surfaces of the sleeve and on the surface of one of the drainage pipe elements, and the other side surface of the sleeve and the surface of the other of the drainage pipe elements have longitudinal mutually co-operating contact elements, whereby axial movement of the sleeve is achieved by relative rotation of the drainage pipe elements.

13. Device according to 12, wherein the threads in one of the drainage pipe elements are arranged on the surface thereof adjacent the helical spurs/recesses in the sleeve, and so that they intersect the helical channels, thereby causing the formation of turbulence in through-flowing fluid, whereby inflow restriction is achieved.

14. Device according to claim 12, wherein the longitudinal contact elements are arranged to intersect the helical channels, causing the formation of turbulence in flow through the channels at points of intersection with the contact elements, whereby an increased inflow restriction is obtained.

15. Device according to claim 11, wherein the threads in one of the drainage pipe elements are arranged on the surface thereof adjacent the helical spurs/recesses in the sleeve, and so that they intersect the helical channels, thereby causing the formation of turbulence in through-flowing fluid, whereby inflow restriction is achieved.

16. Device according to claim 15, wherein the side surface of one of the drainage pipe elements that is adjacent the spurs/recesses in the sleeve comprises a section without threads so that the number of intersections between threads and channels decreases as the sleeve enters the section, thus resulting in a reduction in inflow restriction.

17. Device according to claim 16, wherein the side surface of the drainage pipe element is provided with a section having a shape such that a space or clearance between the sleeve and the side surface is formed, whereby the inflow restriction is further reduced as the sleeve enters the section.

* * * * *